United States Patent [19]

Takeda et al.

[11] Patent Number: 4,971,536

[45] Date of Patent: Nov. 20, 1990

[54] ROTOR FOR FLUIDIC APPARATUS

[75] Inventors: Toshio Takeda, Nagoya; Yoshiharu Okochi, Nishio, both of Japan

[73] Assignee: Aisin Seiki Kabushiki Kaisha, Kariya, Japan

[21] Appl. No.: 401,641

[22] Filed: Sep. 5, 1989

Related U.S. Application Data

[63] Continuation of Ser. No. 171,389, Mar. 21, 1988, abandoned.

[30] Foreign Application Priority Data

Mar. 30, 1987 [JP] Japan ..... 62-077145

[51] Int. Cl.[5] ..... F01C 1/18; F01D 25/00

[52] U.S. Cl. ..... 418/206; 29/447; 164/99; 403/267; 403/269; 415/216.1; 416/244 R

[58] Field of Search ..... 418/206, 179; 164/98, 164/99, 101, 102, 100; 416/241 R, 244 R; 415/216.1; 29/447; 403/267, 269, 273

[56] References Cited

U.S. PATENT DOCUMENTS

| | | | |
|---|---|---|---|
| 2,332,330 | 10/1943 | McMahan | 164/98 |
| 2,340,549 | 2/1944 | Miller | 403/269 |
| 2,754,050 | 7/1956 | Wellington | 416/241 |
| 3,977,459 | 8/1976 | Bonitz | 164/98 |
| 4,145,068 | 3/1979 | Toyomasu et al. | 164/98 |
| 4,293,290 | 10/1981 | Swanson | 418/206 |
| 4,337,817 | 7/1982 | Komatsu | 164/98 |
| 4,462,770 | 7/1984 | Haupt | 418/206 |
| 4,561,484 | 12/1985 | Usui et al. | 164/101 |
| 4,595,349 | 6/1986 | Preston et al. | 418/206 |
| 4,618,791 | 10/1986 | Morrill et al. | 403/269 |
| 4,643,241 | 2/1987 | Yonekura et al. | 164/101 |
| 4,648,817 | 3/1987 | Mariani | 418/206 |
| 4,826,346 | 5/1989 | Nishiura et al. | 403/267 |

FOREIGN PATENT DOCUMENTS

| | | | |
|---|---|---|---|
| 882746 | 7/1949 | Fed. Rep. of Germany . | |
| 2132995 | 7/1970 | Fed. Rep. of Germany | 164/98 |
| 154449 | 9/1983 | Japan | 164/98 |
| 59-63390 | 4/1984 | Japan . | |

*Primary Examiner*—Leonard E. Smith
*Assistant Examiner*—Timothy S. Thorpe
*Attorney, Agent, or Firm*—Oblon, Spivak, McClelland, Maier & Neustadt

[57] ABSTRACT

A rotor for fluidic apparatus such as, blowers, compressors, fluidic motors and vacuum pumps includes a drive shaft having concaved portions on its periphery and a rotatable member cast around the concaved portions of the drive shaft. The rotor according to the present invention is manufactured through the steps of forming the drive shaft, disposing the formed drive shaft into the cavity of a molding die, and then pouring the molten metal into the cavity while disposing the drive shaft therein. The resulted rotor has no play in the direction of its rotation of its rotatable member.

1 Claim, 3 Drawing Sheets

ROTOR FOR FLUIDIC APPARATUS

This application is a continuation of application Ser. No. 171,389, filed on Mar. 21, 1988, now abandoned.

BACKGROUND OF THE INVENTION

1. Field of the Invention

This invention relates to a rotor for fluidic apparatus such as blowers, compressors, fluidic actuation motors, vacuum pumps and the like.

2. Description of the Prior art

In a conventional rotor for the fluidic apparatus, the rotor comprises a drive shaft and a rotatable member rotatably mounted on the drive shaft.

A key and a keyway are used for connection between the drive shaft and the rotatable member.

In case of the key and keyway structure, it is difficult to avoid a clearance in the direction of rotation between the drive shaft and the rotatable member. Therefore, some play is apt to occur in the direction of rotation between the drive shaft and the rotatable member when the rotor rotates circumferentially.

To maintain compressibility efficiency as high as possible in the above mentioned fluidic apparatus such as a pump comprising a housing and the rotors held rotatably within the housing, it is necessary to minimize substantially the clearance between the two rotatable members of the rotors and also between the rotatable members and an inner wall of a housing in which the rotors are accomodated. However, in the case of the conventional pump where some play is necessary in the direction of rotation of the rotatable members, it is unavoidable to design the above clearance considerably larger than is required. This eventually fails in improving the efficiency in areas such as compressibility etc.

Japanese unexamined patent publication No. 63390/1984 discloses a structure in which each of a drive shaft and a rotatable member has a coaxially formed pin hole and a pin is pressed into both pin holes. In this known structure, however, the pin is apt to be deformed, although play in the direction of rotation of rotatable members may be prevented.

SUMMARY OF THE INVENTION

An object of this invention is, therefore, to provide a highly reliable rotor without any play in the direction of rotation and any deformation of the pin.

The rotor of the present invention comprises a drive shaft having at least two concaved, i.e., recessed portions on its periphery and a rotatable member cast around the concave portion of the drive shaft. The concave portions comprise planar shaped portions disposed in a manner facing each other in a direction perpendicular to the axial direction of the steel drive shaft and stepped portions disposed in a manner facing each other in the axial direction of the steel drive shaft.

The manufacture of the rotor of this invention includes steps of forming a drive shaft, disposing the formed drive shaft into the cavity of a molding die, pouring a molten metal into the cavity while disposing the drive shaft therein. When the molten metal is consolidated through cooling off, strong coupling between the drive shaft and the rotatable member is obtained.

The cast rotatable member tightens the concaved portions of the drive shaft because of its large shrinkage when it is consolidated from the molten metal. Thereby, it is possible to assure a coupling strength between the drive shaft and the rotatable member.

In this sense, it is preferable that the rotatable member is made of the materials with a heat shrinkage ratio (i.e. coefficent of thermal expansion) larger than that of drive shaft. The use of the materials having a large heat shrinkage ratio makes it possible to maintain the heat shrinkage amount to be sufficiently large till cooling off the molten metal down to a normal temperature after consolidating, whereby the tightening by the rotatable member becomes stronger.

In the case the drive shaft is made of iron and steel materials, it is preferable to make the rotatable member of a light metal such at aluminium or aluminium alloy. Also, it is desirable to clean the surface of the concaved portions or cover the surface with a coat having a greater affinity with a metal to be cast in order to strengthen the coupling between the drive shaft and the rotatable member.

The larger the pressure on the molten metal when casting, the stronger the degree of contact between the concaved portions and rotatable member becomes.

As a further alternative, the concaved portion may be in the form of gear.

On the outer peripheral portion of drive shaft, it is preferable to form a stop for preventing an axial movement. This construction eliminates a play of the rotatable member in the axial direction because of good engagement between the axial stop and rotatable member.

An advantage of this invention is that the problem of play between the drive shaft and rotatable member can be much improved.

Also, since the rotor of this invention does not use a pin and pin hole structure, there is no problem of pin deformation. Further, a provision of an axial stop at the drive shaft can eliminate any play in the axial direction.

DESCRIPTION OF THE PREFERRED EMBODIMENTS

Figure 1:
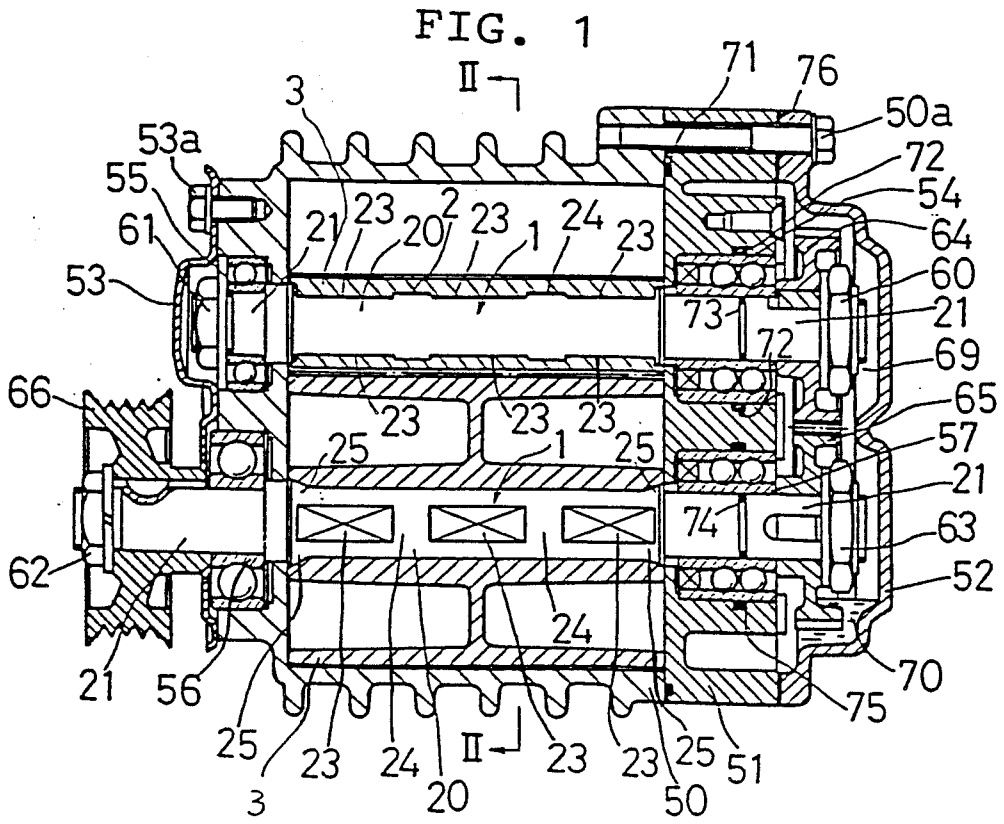
FIG. 1 is a longitudinal cross-sectional view of the Roots type pump to which the first embodiment of the rotor of this invention is applied.

Various other objects, features and attendant advantages of the present invention will be more fully appreciated as the same becomes better understood from the following detailed description when considered in connection with the accompanying drawings.

Referring now to the drawings, in which like reference numerals designate identical or corresponding parts throughout drawings.

EMBODIMENT 1

Figure 2:
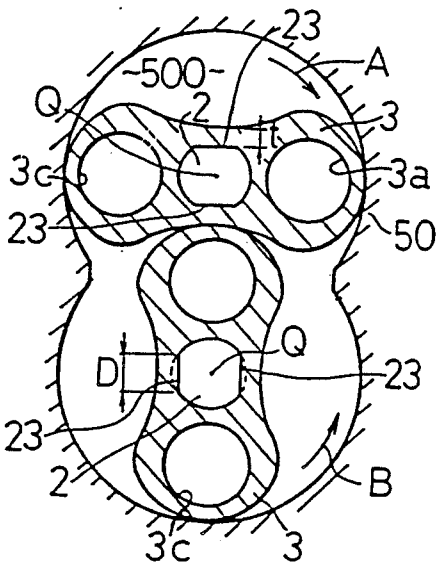
FIG. 2 is a fragmentary transverse cross-sectional view from the plane indicated by the line II—II of FIG. 1.

FIGS. 1 and 2 show the first embodiment wherein the rotor of the present invention is applied to Roots type positive displacement blower.

According to this embodiment, the blower comprises a housing 50 and two rotors 1 held rotatably within the housing 50, and a drive shaft 2 is constituted by a longitudinal drive shaft body 20 having an axis Q and a support 21 provided at both ends thereof.

Each of the rotors 1 is composed of the drive shaft 2 and a rotatable member 3 mounted on the drive shaft 2.

The rotatable member 3 is gourd-shaped and is provided with a hole 3*a* for light weight, absorption of thermal expansion and the like.

As shown in FIG. 1, concaved, i.e., convexed, portions 23 are formed at regular intervals along the longitudinal drive shaft body 20 of the drive shaft 2.

These concaved portions 23 have planar surfaces which face opposite each other and which were formed by chamfering the outer peripheral portions of the longitudinal drive shaft body 20 and stepped portions disposed in a manner facing each other in the axial direction of the steel drive shaft. Each of the concaved portions 23 corresponds to one of the narrow parts of the rotatable member 3 shown in FIG. 2.

Further, axial movement stop portions 24 are formed between the concaved portions 23 on the drive shaft 2.

Also, an axial movement-stop portion 25 is formed at the both ends of the longitudinal drive shaft body 20. Each of the axial movement-stop portions 25 has a gradually increased diameter towards their respective ends.

In the manufacture of each of the two rotors 1 according to the first embodiment of this invention, firstly, the drive shaft 2 made of iron or steel and having the above concaved portions 23 and the axial movement stop portions 24 and 25 are formed. Next, the drive shaft 2 is placed in the cavity of the molding die. Under the condition, molten metal made of aluminium is poured into the cavity to cast around the concaved portions 23 and, the axial movement stop portions 24 and 25.

Since the rotatable members 3 formed by casting as mentioned above have a large shrinkage amount at the time of consolidation from the molten metal, they function to tighten the concaved portions 23, the axial movement convexed stop portions 24 and 25 of the drive shaft 2. Thus, a substantially strong coupling between the drive shaft 2 and the rotatable member 3 is ensured. In other words, it is possible to prevent any play between the drive shaft 2 and the rotatable member 3 in the direction of their rotation.

Furthermore, heat shrinkage amount of the rotatable member 3 is kept as large as possible from the consolidation to cooling off of the molten metal made of aluminium alloy, which may substantially contribute to improvement of the degree of tightening. In this case, the area of the planar concaved portions 23 can be made sufficiently large by increasing its widthwise dimention D, whereby a sufficient coupling strength is assured.

According to the embodiment, as shown in FIG. 1, there are provided at regular intervals three concaved portions 23 along the length of the longitudinal drive shaft body 20. Therefore, this structure gives an advantage that even if the longer drive shaft 2 is used, there occurs no play in the direction of the rotation of the shaft 2.

Further, it is possible to get the concaved stop portions 23 nearer the periphery of the rotatable member 3 along the axial center Q of the drive shaft. Thus, the degree of the gourd-shaped narrow part of the rotatable member 3 can be very large. Accordingly, with the smaller configuration of the housing 50, a larger space for a pumping chamber is obtained. It is to be noted that the concaved portions 23 may be formed as an irregular surface instead of the planar one.

Referring to FIGS. 1 and 2, the two rotors 1 are built in the Roots type positive displacement blower is provided with a space 500 forming a gourd-shaped pumping chamber, a housing 50 having air inlet and air exhausting holes, a plate 51 and a cover 52 abutting with the housing 50 by means of a bolt 50*a*, and a cover 53 abutting with the housing 50 by means of a bolt 53*a*.

In the gourd-shaped space 500 in the housing 50, the two rotatable members 3 of the rotors 1 are provided in shifted phase relation. Each of the ends 21 of the drive shafts 2 is rotatably supported by the respective bearings 54, 55, 56 and 57.

For prevention of coming of the drive shafts 2, bolts 60, 61, 62 and 63 are provided.

One of the two rotatable members 3 has a gear 64 at its end 21, and the other has a gear 65 and a pulley 66. The above pulley 66 which is driven through a belt (not shown) is provided to transmit the rotation to the rotatable members 3 in the direction of the arrow B. Thus, by the engagement between the gears 64 and 65, the two rotatable members 3 rotate in the direction of the arrow A, whereby air suctioned through the exhausting hole is compressed and exhausted therefrom.

In the liquid tight bottom portion of the space 69 formed by the cover 52 and the plate 51, circulating oil 70 is accomodated.

For complete sealing of the circulating oil and compressed air, the members 71, 72, 73, 74, 75 and 76 are provided.

The operation of the rotor 1 built in the Roots type blower will more be described hereinafter.

When the rotatable members 3 are rotated, the concaved portions 23 serve to prevent any play between the drive shafts 2 and the rotatable members 3 in the direction of the rotation. In addition, the axial movement stop portions 24 and 25 function to prevent any play between the drive shafts 2 and the rotatable members 3. Accordingly, clearance between the two rotatable members 3, and between these rotatable members 3 and the inner wall of the housing 50 in which the space 500 is formed, can be made sufficiently small. This contributes to improving the compressibility efficiency.

EMBODIMENT 2

Figure 3:
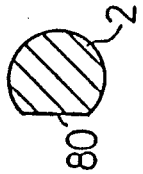
FIG. 3 is a transeverse cross-sectional view of the drive shaft according to the second embodiment of the present invention.

FIG. 3 shows the second embodiment of this invention. In this embodiment, concaved portions 80 are the planar portions formed on one lateral side of the periphery of the drive shafts 2.

EMBODIMENT 3

Figure 4:
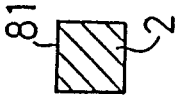
FIG. 4 is a transverse cross-sectional view of the drive shaft according to the third embodiment of the present invention.

FIG. 4 shows the third embodiment of this invention. In this embodiment, the concaved portions are constituted by four planar portions 81 on the periphery of the drive shafts 2. In this case, the cross-section of each of the drive shafts 2 is rectangular.

EMBODIMENT 4

Figure 5:
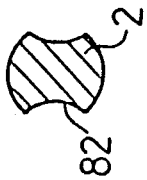
FIG. 5 is a transverse cross-sectional view of the drive shaft according to the fourth embodiment of the present invention.

FIG. 5 shows the fourth embodiment of this invention. In this embodiment, concaved portions 82 are constituted by two circular arc recessed portions on the periphery of the drive shafts 2. The cross section of each of the drive shafts 2 is gourd-shaped.

EMBODIMENT 5

Figure 6:
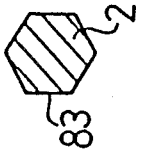
FIG. 6 is a transverse cross sectional view of the drive shaft according to the fifth embodiment of the present invention.

FIG. 6 shows the fifth embodiment of this invention. In this embodiment, concaved portions 83 are constituted by the six planar portions on the periphery of the drive shafts 2.

The cross section of the drive shafts 2 having such concaved portions 83 is hexagon.

EMBODIMENT 6

Figure 7:
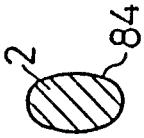
FIG. 7 is a transverse cross-sectional view of the drive shaft according to the sixth embodiment of the present invention.

FIG. 7 shows the sixth embodiment of this invention. In this embodiment, concaved portions 84 are constituted by two circular arc portions on the periphery of the drive shafts 2.

The cross section of the concaved portions 84 is oval or elliptical.

EMBODIMENT 7

Figure 8:
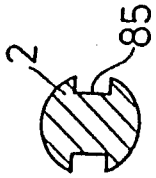
FIG. 8 is a transverse cross-sectional view of the drive shaft according to the seventh embodiment of the present invention.

FIG. 8 shows the seventh embodiment of this invention. In this embodiment, concaved portions 85 are constituted by two cut-out portions on the periphery of the drive shafts 2.

The operation of each of the embodiments 2–7 is the same as that of the first embodiment as shown in FIGS. 1 and 2.

What we claim is:

1. A rotor for a fluidic apparatus comprising:

a steel drive shaft having a column shape and plural pairs of recessed portions arranged in an axial direction of said steel drive shaft at predetermined intervals, wherein each said pair of recessed portions comprises at least two recessed portions which are placed on radially opposite surfaces of said steel drive shaft; and a rotatable member cast around said plural pairs of recessed portions and parts of the steel drive shaft between said pairs of recessed portions, wherein said rotatable member is formed of a light metal, and wherein each said recessed portion has a plane parallel to the axis of said steel drive shaft and plural planes perpendicular to said axis of said steel drive shaft.

* * * * *